US005913292A

United States Patent [19]

Takemura et al.

[11] Patent Number: 5,913,292

[45] Date of Patent: Jun. 22, 1999

[54] VARIABLE VALVE TIMING AND LIFT MECHANISM OF INTERNAL COMBUSTION ENGINE

[75] Inventors: Shinichi Takemura; Makoto Nakamura; Akira Hidaka, all of Kanagawa, Japan

[73] Assignee: Unisia Jecs Corporation, Atsugi, Japan

[21] Appl. No.: 09/064,820

[22] Filed: Apr. 23, 1998

[30] Foreign Application Priority Data

Apr. 23, 1997 [JP] Japan ..... 9-105524

[51] Int. Cl.[6] ..... F01L 13/00

[52] U.S. Cl. ..... 123/90.17; 123/90.31; 123/90.34

[58] Field of Search ..... 123/90.15, 90.16, 123/90.17, 90.31, 90.33, 90.34

[56] References Cited

U.S. PATENT DOCUMENTS

| | | | |
|---|---|---|---|
| 5,557,983 | 9/1996 | Hara et al. | 123/90.17 |
| 5,636,603 | 6/1997 | Nakamura et al. | 123/90.17 |
| 5,645,020 | 7/1997 | Yamada | 123/90.17 |
| 5,709,179 | 1/1998 | Hara et al. | 123/90.17 |
| 5,787,849 | 8/1998 | Mitchell | 123/90.17 |

FOREIGN PATENT DOCUMENTS 57-198306 12/1982 Japan .

6-185321 7/1994 Japan .

*Primary Examiner*—Weilun Lo
*Attorney, Agent, or Firm*—Foley & Lardner

[57] ABSTRACT

A drive shaft is synchronously driven by an internal combustion engine. A cylindrical hollow cam shaft is rotatably disposed about the drive shaft. The cam shaft has thereon a cam which actuates a valve of the engine. A first flange is formed on one end of the cam shaft. A second flange is connected to the drive shaft to rotate therewith. The second flange faces the first flange. First and second radially extending grooves are formed in mutually facing surfaces of the first and second flanges respectively. The first and second grooves are arranged at opposite sides with respect to an axis of the drive shaft. An annular disc is disposed between the first and second flanges. The annular disc has first and second pins which are slidably engaged with the first and second grooves respectively. A control housing rotatably receives therein the annular disc. The control housing is pivotal in a direction perpendicular to an axis of the drive shaft and has therein a cam receiving circular opening. A control shaft has thereon a circular eccentric cam which is slidably received in the cam receiving circular opening of the control housing. A pair of annular flanges are provided on the control shaft to intimately put therebetween a thicker portion of the control housing thereby to suppress an undesired axial displacement of the control housing on and along the control shaft.

9 Claims, 5 Drawing Sheets

VARIABLE VALVE TIMING AND LIFT MECHANISM OF INTERNAL COMBUSTION ENGINE

BACKGROUND OF THE INVENTION

1. Field of the Invention

The present invention relates in general to mechanisms for driving intake and exhaust valves of an internal combustion engine, and more particularly to the valve drive mechanisms of a type which can vary the opening/closing timing and lifting angle of the intake and exhaust valves in accordance with an operating condition of the engine. More specifically, the present invention is concerned with a so-called a variable valve timing and lift mechanism of an internal combustion engine.

2. Description of the Prior Art

In the variable valve timing and lift mechanisms, there is a type in which a cylindrical hollow cam shaft is rotatably disposed on a drive shaft. By making a certain rotation of the cam shaft relative to the drive shaft, the opening/closing timing and lifting angle of the intake and exhaust valves can be changed. Some of the mechanisms of such type are described in Japanese Utility Model First Provisional Publication 57-198306 and Japanese Patent First Provisional Publication 6-185321.

In the mechanisms of these publications, cylindrical hollow cam shafts for respective cylinders are rotatably disposed on a common drive shaft which rotates synchronously with operation of the engine. A circular flange of each cam shaft and a corresponding circular flange of the drive shaft are respectively formed with radially extending guide grooves. An annular disc is put between the circular flanges in such a manner that respective pins provided on opposed faces of the annular disc are slidably engaged with the guide grooves respectively. The annular disc is rotatably held by a control housing which can pivot the annular disc to an eccentric position relative to the cam shaft (or drive shaft). Thus, by changing the eccentric degree of the annular disc, the valve lift characteristic of the corresponding valve of the engine can be varied or adjusted. In the mechanism of the '321 publication, there is employed an eccentric cam for pivoting the control housing in a direction perpendicular to the axis of the cam shaft. That is, the control housing is pivotally supported by a supporting shaft and has a cam receiving circular opening, and the eccentric cam formed on a control shaft is rotatably received in the cam receiving circular opening. By pivoting the control shaft about its axis to a desired angular position by an actuator, the pivoting movement of the control housing is carried out.

In the variable valve timing and lift mechanisms of the above-mentioned type, it is very important to strictly suppress axial displacement of the control housing and to precisely hold the control housing in a desired angular position. In fact, under operation of the engine, a marked force is inherently applied to the cam shaft from a valve spring and thus the annular disc is biased in a direction to be inclined. If the annular disc is actually inclined upon receiving such force, the control housing would be inclined also, which however interrupts a smoothed rotation transmission from the drive shaft to the cam shaft.

SUMMARY OF THE INVENTION

It is therefore an object of the present invention to provide a variable valve timing and lift mechanism of an internal combustion engine, wherein a control housing for receiving an annular disc can be precisely positioned relative to a control shaft while assuredly suppressing undesired axial displacement thereof on and along the control shaft.

According to a first aspect the present invention, there is provided a variable valve timing and lift mechanism of an internal combustion engine. The mechanism comprises a drive shaft synchronously driven by the engine; a cylindrical hollow cam shaft rotatably disposed about the drive shaft, the cam shaft having thereon a cam which actuates a valve of the engine; a first flange provided on one end of the cam shaft; a second flange connected to the drive shaft to rotate therewith, the second flange facing the first flange; first and second radially extending grooves formed in mutually facing surfaces of the first and second flanges respectively, the first and second grooves being arranged at opposite sides with respect to an axis of the drive shaft; an annular disc disposed between the first and second flanges, the annular disc having first and second pins which are slidably engaged with the first and second grooves respectively; a control housing rotatably receiving therein the annular disc, the control housing being pivotal in a direction perpendicular to an axis of the drive shaft and having therein a cam receiving circular opening; a control shaft having thereon a circular eccentric cam which is slidably received in the cam receiving circular opening of the control housing; and a stopper structure provided on the control shaft to suppress an axial displacement of the control housing on the control shaft.

According to a second aspect of the present invention, there is provided a variable valve timing and lift mechanism of an internal combustion engine. The mechanism comprises a drive shaft synchronously driven by the engine; a cylindrical hollow cam shaft rotatably disposed about the drive shaft, the cam shaft having thereon a cam which actuates a valve of the engine; a first flange provided on one end of the cam shaft; a second flange connected to the drive shaft to rotate therewith, the second flange facing the first flange; first and second radially extending grooves formed in mutually facing surfaces of the first and second flanges respectively, the first and second grooves being arranged at opposite sides with respect to an axis of the drive shaft; an annular disc spacedly disposed about the drive shaft at a position between the first and second flanges, the annular disc having first and second pins which are slidably engaged with the first and second grooves respectively; a control housing rotatably receiving therein the annular disc, the control housing being pivotal in a direction perpendicular to an axis of the drive shaft and having therein a cam receiving circular opening; a control shaft having thereon a circular eccentric cam which is slidably received in the cam receiving circular opening of the control housing; and a pair of spaced annular flanges provided on the control shaft, the annular flanges intimately putting therebetween a portion of the control housing to suppress an axial displacement of the control housing on and along the control shaft.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
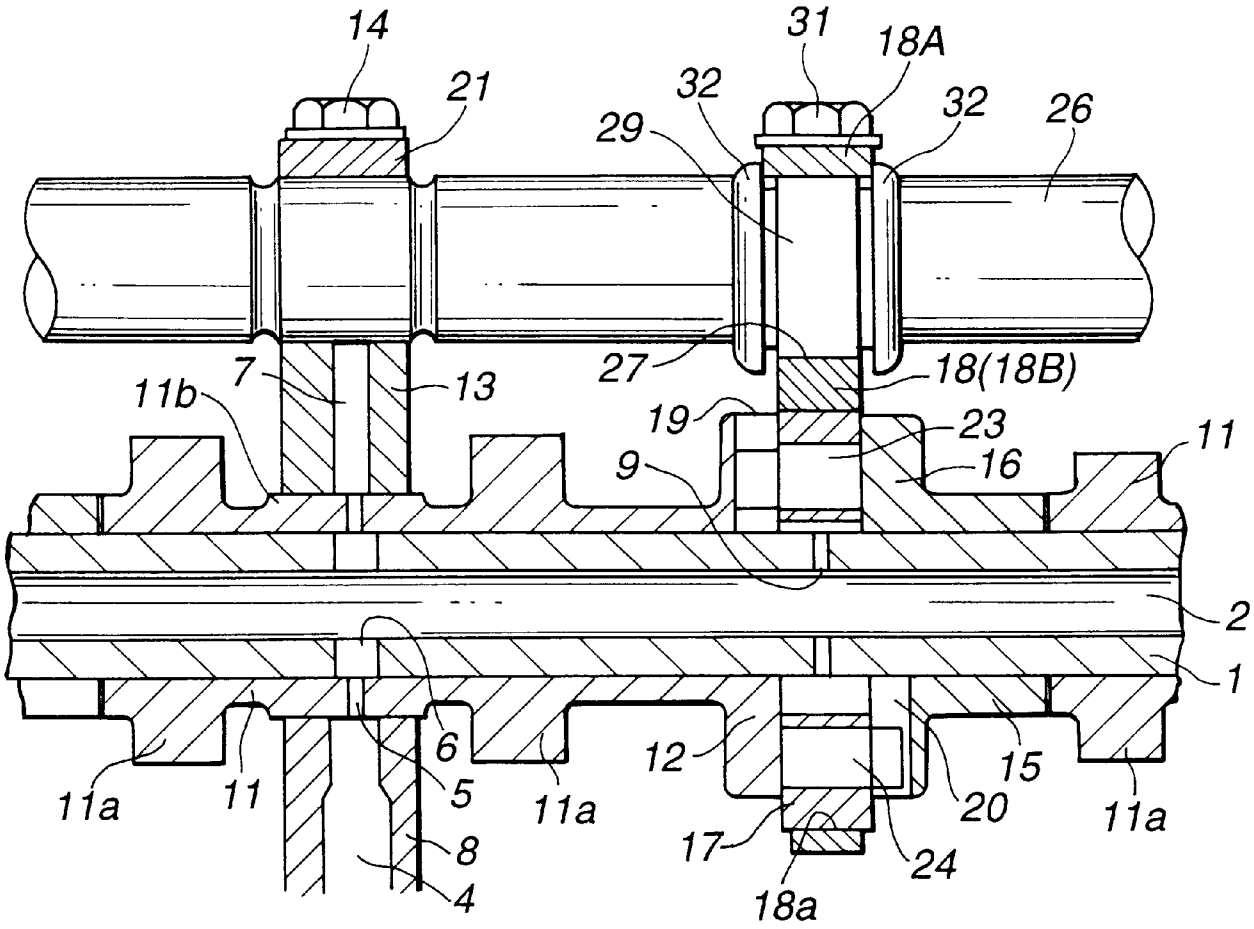
FIG. 1 is a sectional view of an essential portion of a variable valve timing and lift mechanism which is a first embodiment of the present invention.
Figure 2:
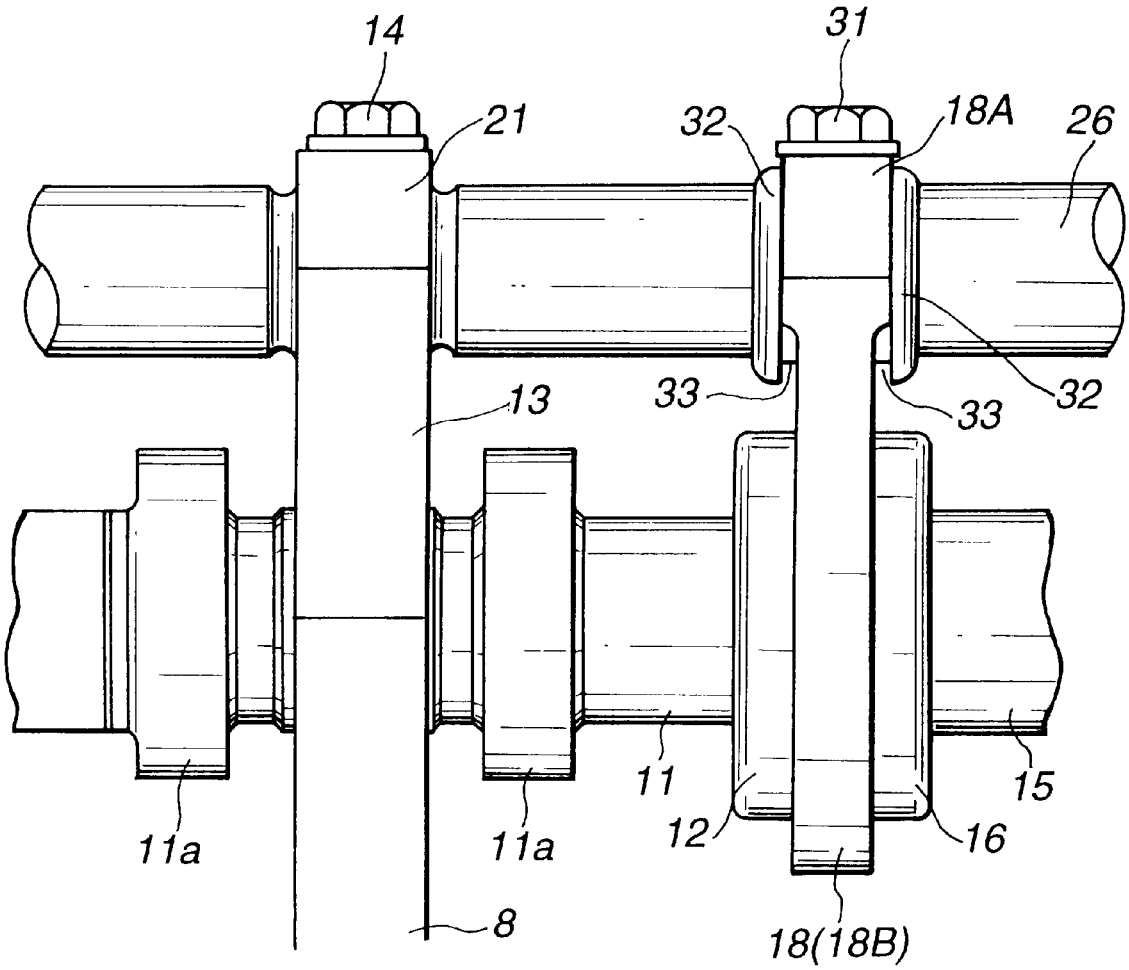
FIG. 2 is a side view of the essential portion of the variable valve timing and lift mechanism of the first embodiment.

Referring to FIGS. 1 and 2, there is shown but partially a variable valve timing and lift mechanism which is a first embodiment of the present invention.

As will be understood from FIG. 1, a drive shaft 1 extends above and along a cylinder head (not shown) of an internal combustion engine. That is, the drive shaft 1 extends above all of cylinders (not shown) of the engine. The drive shaft 1 is formed with an axially extending passage 2 through which lubricating oil flows. Although not shown in the drawings, a sprocket is secured to one end of the drive shaft 1. The sprocket is connected through a timing chain (not shown) to a crankshaft (not shown). Thus, the drive shaft 1 is synchronously driven by the engine.

About the drive shaft 1, there are rotatably disposed a plurality of cylindrical cam shafts 11 whose number corresponds to that of the cylinders possessed by the engine. More specifically, each cylindrical cam shaft 11 is positioned above a corresponding cylinder.

Each cam shaft 11 is formed at one end with a first flange 12. The cam shaft 11 is formed with a pair of cams 11*a* for actuating, for example, intake valves. A journal portion 11*b* defined between the paired cams 11*a* and 11*b* is rotatably held between a cam bracket mounting portion 8 and a cam bracket 13. For rotatably holding the journal portion 11*b*, both the cam bracket mounting portion 8 and the cam bracket 13 have semicircular recesses respectively which face each other having the journal portion 11*b* held therebetween. The cam bracket mounting portion 8 is an extension of a partition wall of the cylinder head. The cam bracket mounting portion 8 is formed with an oil flow passage 4 which is communicated with an oil gallery formed in the cylinder head. The oil flow passage 4 is communicated with the oil passage 2 of the drive shaft 1 through diametrically opposed openings 5 formed in the journal portion 11*b* and diametrically opposed openings 6 formed in the drive shaft 1, as shown. Thus, under operation of the engine, lubricating oil can flow from the passage 4 toward the oil passage 2.

To the drive shaft 1, there are secured sleeves 15. Each sleeve 15 is formed at one end with a second flange 16 which faces the above-mentioned first flange 12 of the corresponding cam shaft 11.

Between the first and second flanges 12 and 16, there is disposed an annular disc 17 which movably surrounds the drive shaft 1. The annular disc 17 is intimately and rotatably disposed in a circular opening 18*a* formed in a control housing 18. That is, as is seen from FIG. 3, a cylindrical outer wall of the annular disc 17 slidably contacts a cylindrical inner wall of the circular opening 18*a* of the control housing 18.

Referring back to FIGS. 1 and 2, the cam shaft 11 is constantly biased toward the sleeve 15 by a spring (not shown). Thus, the annular disc 17 is constantly pressed by the first and 11*a* second flanges 12 and 16.

The first and second flanges 12 and 16 are formed at mutually facing side surfaces with respective grooves 19 and 20 each extending radially. These grooves 19 and 20 are arranged at diametrically opposite positions with respect to the axis of the drive shaft 1.

The annular disc 17 is formed at diametrically opposite portions with holding bores in which first and second pins 23 and 24 are rotatably held. The first pin 23 has a projected end slidably received in the groove 19 of the first flange 12, while the second pin 24 has a projected end slidably received in the groove 20 of the second flange 16. That is, the first and second pins 23 and 24 project in opposite directions for the respective engagement with the grooves 19 and 20 of the first and second flanges 12 and 16.

It is to be noted that each of the projected ends of the first and second pins 23 and 24 has parallel opposed surfaces which slidably engage with opposed side walls of the corresponding groove 19 or 20.

For lubricating the first and second pins 23 and 24 in the grooves 19 and 20, the drive shaft 1 is formed with diametrically extending oil openings 9 through which lubricating oil flows from the oil passage 2 of the drive shaft 1 to an inner surface of the annular disc 17.

When the annular disc 17 takes a position concentric with the drive shaft 1, the cam shaft 11 rotates at the same speed as the drive shaft 1. Under this condition, the corresponding valves (viz., intake valves) obtain a valve lift characteristic provided by the profile of the cams 11*a*. While, when the annular disc 17 takes a position eccentric to the drive shaft 1, the cam shaft 11 is forced to rotate at a speed different from that of the drive shaft 1. That is, the opening/closing timing and lifting angle of the valves are varied in accordance with the eccentric degree of the annular disc 17 relative to the drive shaft 1. Operation of the annular disc 17 is described in the above-mentioned Japanese publication 6-185321.

The control housing 18 can pivot but slightly in a direction perpendicular to the axis of the drive shaft 1.

Figure 3:
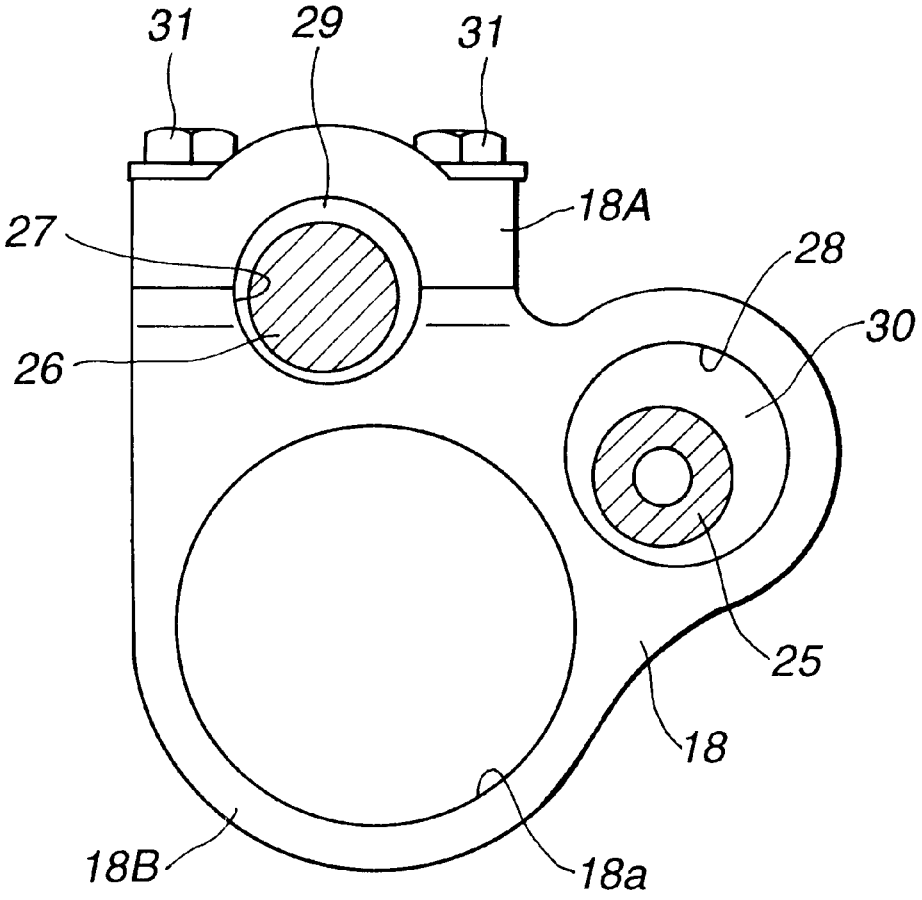
FIG. 3 is a front view of a control housing employed in the first embodiment.

As is understood from FIGS. 1 and 3, the control housing 18 is supported by both a stationary shaft 25 and a control shaft 26. These shafts 25 and 26 extend in parallel with the drive shaft 1. Similar to the drive shaft 1, these two shafts 25 and 26 extend throughout the arrangement of all of the cylinders of the engine.

As is seen from FIG. 3, the control housing 18 is formed at an upper portion with a cam receiving circular opening 27 and at a side upper portion with a bush receiving circular opening 28. Within the circular openings 27 and 28, there are rotatably installed a circular eccentric cam 29 and a circular eccentric bush 30 respectively. The cam 29 is secured to the control shaft 26 to rotate therewith. While, the bush 30 is rotatably connected to the stationary shaft 25. As is seen from the drawing, each of the cam 29 and bush 30 is eccentric to the corresponding shaft 26 or 25. Accordingly, when the control shaft 26 rotates about its axis, the control housing 18 is forced to swing up or down in FIG. 3, so that the center of the annular disc 17 (see FIG. 1) becomes eccentric relative to the axis of the cam shaft 11 (or the drive shaft 1).

Although not shown in the drawings, the control shaft 26 has one end connected to a hydraulic actuator. At the other end of the control shaft 26, there is arranged an angular position sensor (not shown) which senses an angular position of the control shaft 26.

As is seen from FIG. 2, the control shaft 26 is rotatably held between the cam bracket 13 and a bracket cap 21. For rotatably holding the control shaft 26, both the cam bracket 13 and the cap 21 have semicircular recesses respectively which face each other with the control shaft 26 held therebetween. The bracket cap 21 is secured to the cam bracket 13 by means of a pair of bolts 14. By the bolts 14, the cam bracket 13 is secured to the cam bracket mounting portion 8. As is seen from FIG. 1, the cam bracket 13 is formed with an oil passage 7 whose one end faces the opening 6 of the drive shaft 1. Thus, under operation of the engine, the lubricating oil can flow from the passage 4 of the drive shaft 1 to the passage 7 to lubricate the bearing portion of the cam bracket 13 where the control shaft 26 is rotatably held.

The stationary shaft 25 on which the circular bushes 30 are rotatably held is fixed to the cylinder head.

For strictly suppressing axial displacement of the control housing 18 and precisely holding the same in a desired angular position, the following measures are employed in the present invention.

As is seen from FIG. 1, the control shaft 26 is integrally formed with a pair of annular flanges 32 by and between which the control housing 18 is sandwiched. That is, the two flanges 32 are arranged to hold therebetween the circular eccentric cam 29 through the control housing 18. If desired, the annular flanges 32 may be members connected to the control shaft 26.

As is seen from FIGS. 2 and 3, the control housing 18 generally consists of two parts 18A and 18B which are connected at a dividing face which passes through a center of the opening 27. The part 18A is shaped to serve as a cap for the part 18B which serves as a major part of the control housing 18. That is, the cap part 18A has at a lower end a semicircular recess which constitutes an upper half of the circular opening 27, while the major part 18B has, in addition to the circular opening 18*a* and the circular opening 28, at an upper end a semicircular recess which constitutes a lower half of the circular opening 27.

As is seen from FIG. 3, the cap part 18A is secured to the major part 18B by means of a pair of bolts 31.

As is seen from FIG. 2, the thickness of the cap part 18A and that of an upper portion of the major part 18B are the same and greater than that of a major portion of the major part 18B. In other words, only an upper portion of the control housing 18, which is remote from the annular disc 17, has a thicker structure to intimately contact with inside flat surfaces of the two annular flanges 32, and the remaining portion of the control housing 18, which is near the annular disc 17, has a thinner structure. Thus, there is defined a space 33 between the thinner remaining portion and each of the annular flange 32.

As is seen from FIG. 1, the annular disc 17 in the circular opening 18*a* of the control housing 18 is sandwiched between the first and second flanges 12 and 16 and pressed by the same. Thus, undesired axial displacement of the annular disc 17 in the control housing 18 is suppressed. As is described hereinabove, due to the annular flanges 32 provided on the control shaft 26, the control housing 18 is suppressed from making undesired axial displacement. Thus, even when the annular disc 17 is applied with a marked force from the valve spring through the cam shaft 11 under operation of the engine, the control housing 18 is suppressed from being inclined with respect to the axis of the control shaft 26. Since the portion where the control housing 18 is actually supported by the control shaft 26 has a considerable distance from the center of the annular disc 17, suppression of the undesired inclination phenomenon of the control housing 18 is promoted. Accordingly, the sliding engagement of the circular eccentric cam 29 with the circular opening 27 is smoothly and precisely achieved, so that the pivotal movement of the control housing 18 induced by the rotation of the control shaft 26 is smoothly carried out. In other words, smoothed rotation transmission from the drive shaft 1 to the cam shaft 11 through the annular disc 17.

Under operation of the engine, the lubricating oil in the oil passage 2 of the drive shaft 1 is forced to flow to the inner surface of the annular disc 17 through the openings 9, and then flow radially outward due to a centrifugal force inherently generated. Thus, the pins 23 and 24 and the grooves 19 and 20 are effectively lubricated by the oil. The lubricating oil from these parts 23, 24, 19 and 20 is then guided to the cam receiving circular opening 27 through the spaces 33 (see FIG. 2) which are provided by the thinner lower portion of the control housing 18. Thus, the circular eccentric cam 29 and the circular opening 27 are assuredly lubricated lowering friction loss of these parts.

Figure 4:
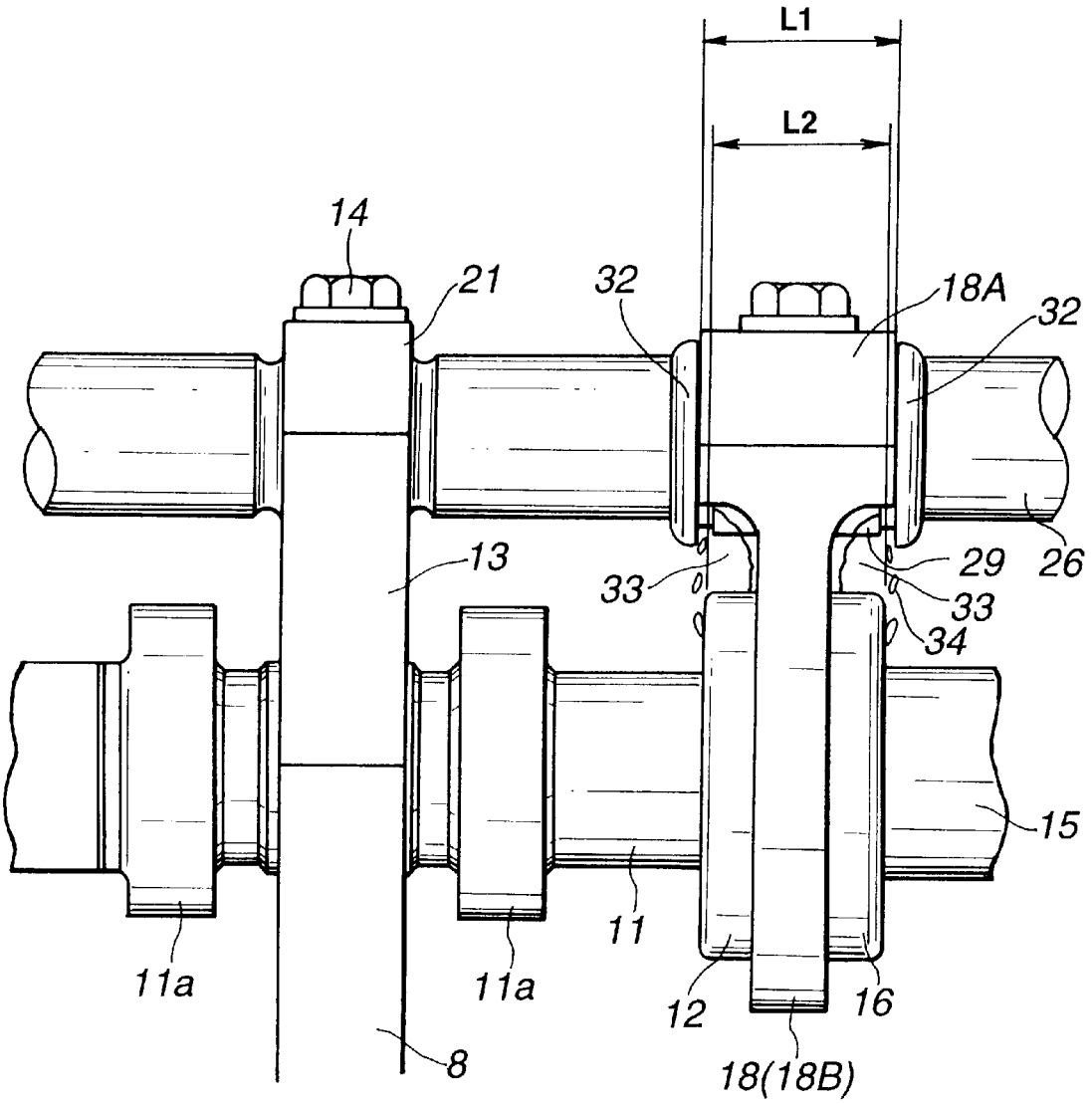
FIG. 4 is a view similar to FIG. 2, but showing a second embodiment of the present invention.

Referring to FIG. 4, there is shown but partially a variable valve timing and lift mechanism which is a second embodiment of the present invention. Since the second embodiment is similar in construction to the above-mentioned first embodiment, only portions which are different from those of the first embodiment will be described in the following.

In the second embodiment, the thicker upper portion 18A of the control housing 18 is much thicker than that of the first embodiment. More specifically, the thickness "L1" of the thicker upper portion 18A is somewhat greater than the distance "L2" between an outside surface of the first flange 12 of the cam shaft 11 and an outside surface of the second flange 16 of the sleeve 15. That is, the thicker upper portion 18A is so sized as to substantially cover upper portions of the flanges 12 and 16 and the annular disc 17. Thus, the annular flanges 32 of the control shaft 26 are spaced by the distance of "L1".

In this second embodiment, the sliding engagement between the circular eccentric cam 29 (see FIG. 3) and the circular opening 27 is made with increased contacting surfaces, and the sliding engagement between the thicket upper portion 18A (see FIG. 4) of the control housing 18 and the annular flanges 32 is made with an increased distance between the flanges 32. Thus, suppression of the undesired inclination phenomenon of the control housing 18 is much effectively achieved. Furthermore, as is understood from the drawing, due to the increased thickness of the upper portion of the control housing 18, the lubricating oil scattering radially outward from the annular disc 17 is effectively guided to the cam receiving circular opening 27 through the spaces 33.

Figure 5:
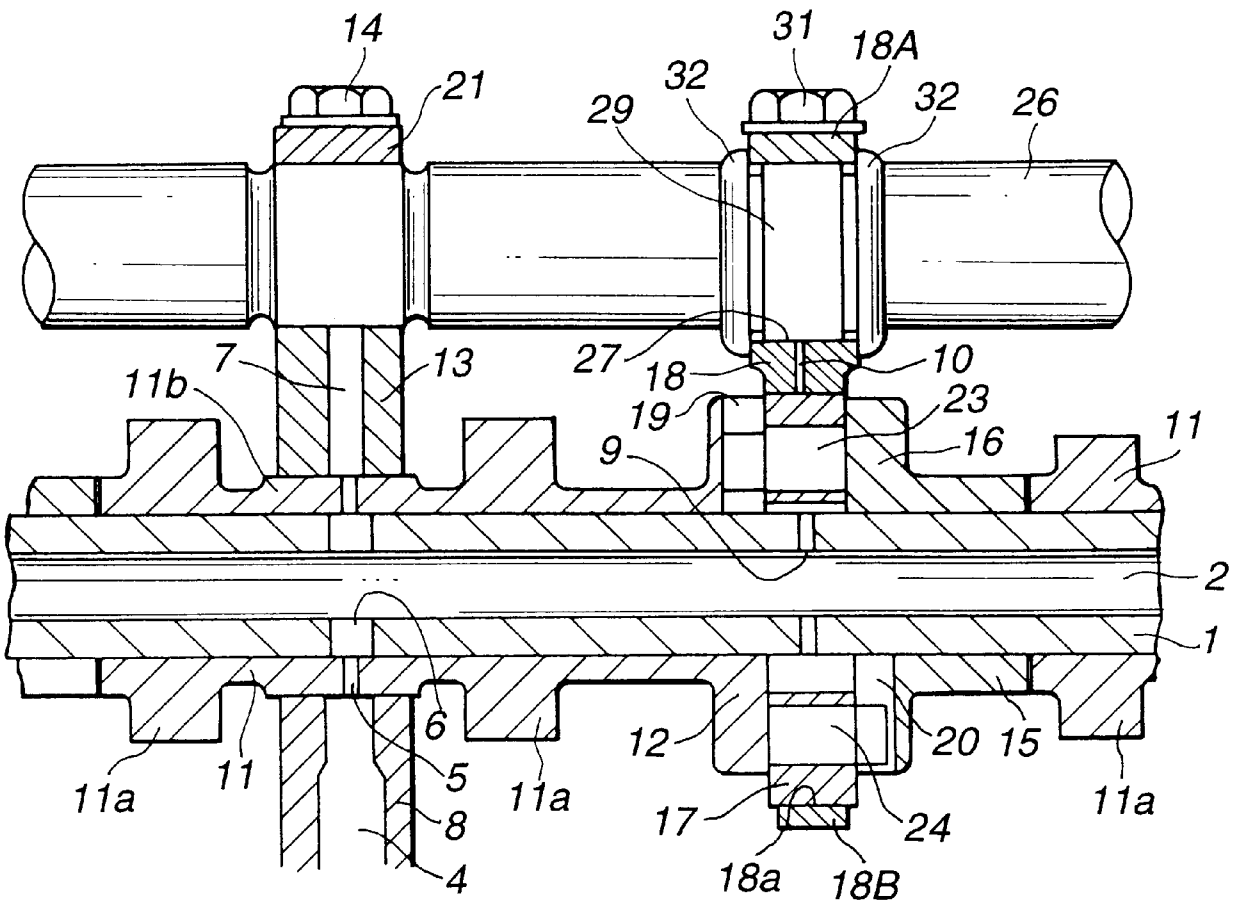
FIG. 5 is a view similar to FIG. 1, but showing a third embodiment of the present invention.

Referring to FIG. 5, there is shown but partially a variable timing and lift mechanism which is a third embodiment of the present invention. Since the third embodiment is similar in construction to the above-mentioned first embodiment, only portions which are different from those of the first embodiment will be described in the following.

In the third embodiment, an oil passage 10 is formed in the control housing 18, which extends from the circular opening 18*a* to the cam receiving circular opening 27. That is, the oil passage 10 is provided in the major part 18B of the control housing 18. Furthermore, in the third embodiment, the thickness of the cap part 18A is greater than that of the lower thinner portion of the major part 18B, and the thickness of the upper thicker portion of the major part 18B is equal to that of the cap part 18A. In other words, an upper portion of the control housing 18 where the entire of the circular opening 27 is provided has a thicker construction. Thus, the inside flat surfaces of the annular flanges 32 of the control shaft 26 are entirely in contact with opposed surfaces of the thicker upper portion of the control housing 18.

In this third embodiment, the inside flat surfaces of the annular flanges 32 of the control shaft 26 entirely contact the opposed surfaces of the thicker upper portion of the control housing 18. Thus, suppression of the undesired inclination phenomenon of the control housing 18 is much effectively achieved. Since the thicker upper portion of the major part 18B has the thickness equal to the distance between the two annular flanges 32 of the control shaft 26, positioning of the control housing 18 is easily made when upon assembly of the same to the control shaft 26. Due to provision of the oil passage 10, the lubricating oil from the outer surface of the annular disc 17 is effectively led into the cam receiving circular opening 27 for lubricating the circular eccentric cam 29 in the opening 27. Due to an enclosed structure defined by the two annular flanges 32 and the thicker upper portion of the major part 18B and the cap part 18A, outflow of the lubricating oil from the structure is controlled, which promotes a sufficient lubrication of the cam 29.

It is to be understood that, although the invention has been described with specific reference to particular embodiments thereof, it is not to be so limited since changes and alternations therein may be made within the full intended scope of this invention as defined by the appended claims.

What is claimed is:

1. A variable valve timing and lift mechanism of an internal combustion engine, comprising:

a drive shaft synchronously driven by the engine;

a cylindrical hollow cam shaft rotatably disposed about said drive shaft, said cam shaft having thereon a cam which actuates a valve of the engine;

a first flange provided on one end of said cam shaft;

a second flange connected to said drive shaft to rotate therewith, said second flange facing said first flange;

first and second radially extending grooves formed in mutually facing surfaces of said first and second flanges respectively, said first and second grooves being arranged at opposite sides with respect to an axis of said drive shaft;

an annular disc disposed between said first and second flanges, said annular disc having first and second pins which are slidably engaged with said first and second grooves respectively;

a control housing rotatably receiving therein said annular disc, said control housing being pivotal in a direction perpendicular to an axis of said drive shaft and having therein a cam receiving circular opening;

a control shaft having thereon a circular eccentric cam which is slidably received in said cam receiving circular opening of said control housing; and a stopper structure provided on said control shaft to suppress an axial displacement of said control housing on said control shaft.

2. A variable valve timing and lift mechanism as claimed in claim 1, in which said stopper structure comprises:

a pair of annular flanges which are arranged on said control shaft in such a manner as to put therebetween said control housing.

3. A variable valve timing and lift mechanism as claimed in claim 2, in which said control housing comprises:

a thicker portion in which a part of said cam receiving circular opening is provided, said thicker portion intimately contacting said annular flanges; and a thinner portion which constitutes the portion which actually receives therein said annular disc.

4. A variable valve timing and lift mechanism as claimed in claim 3, in which said drive shaft is formed with diametrically extending oil openings through which lubricating oil flows into an inner surface of said annular disc from an axially extending oil passage formed in said drive shaft.

5. A variable valve timing and lift mechanism as claimed in claim 4, in which the thickness of said thicker portion of the control housing is greater than the distance between outside surfaces of said annular flanges of said control shaft.

6. A variable valve timing and lift mechanism as claimed in claim 2, in which said control housing is formed with an oil passage which extends to said cam receiving circular opening from a circular opening in which said annular disc is rotatably disposed, and in which a thicker portion of said control housing in which said cam receiving circular opening is provided is entirely in contact with inside surfaces of said annular flanges of said control shaft.

7. A variable valve timing and lift mechanism as claimed in claim 2, in which said control housing comprises:

two parts which are united by bolts, said two parts being mated at a diving face which passes through a center of said cam receiving circular opening.

8. A variable valve timing and lift mechanism of an internal combustion engine, comprising:

a drive shaft synchronously driven by the engine;

a cylindrical hollow cam shaft rotatably disposed about said drive shaft, said cam shaft having thereon a cam which actuates a valve of the engine;

a first flange provided on one end of said cam shaft;

a second flange connected to said drive shaft to rotate therewith, said second flange facing said first flange;

first and second radially extending grooves formed in mutually facing surfaces of said first and second flanges respectively, said first and second grooves being arranged at opposite sides with respect to an axis of said drive shaft;

an annular disc spacedly disposed about said drive shaft at a position between said first and second flanges, said annular disc having first and second pins which are slidably engaged with said first and second grooves respectively;

a control housing rotatably receiving therein said annular disc, said control housing being pivotal in a direction perpendicular to an axis of said drive shaft and having therein a cam receiving circular opening;

a control shaft having thereon a circular eccentric cam which is slidably received in said cam receiving circular opening of said control housing; and a pair of spaced annular flanges provided on said control shaft, said annular flanges intimately putting therebetween a portion of said control housing to suppress an axial displacement of said control housing on and along said control shaft.

9. A variable valve timing and lift mechanism as claimed in claim 8, in which said pair of spaced annular flanges are integral with said control shaft.

* * * * *